US006149291A

United States Patent [19]

Christenson

[11] Patent Number: 6,149,291

[45] Date of Patent: Nov. 21, 2000

[54] CONCRETE MIXING DRUM FIN STRUCTURE

[75] Inventor: Ronald E. Christenson, Parsons, Tenn.

[73] Assignee: McNeilus Truck and Manufacturing, Inc., Dodge Center, Minn.

[21] Appl. No.: 09/300,013

[22] Filed: Apr. 27, 1999

[51] Int. Cl.[7] ..... B28C 5/22

[52] U.S. Cl. ..... 366/59

[58] Field of Search ..... 366/59, 58, 57, 366/56, 54, 53, 227, 228, 229, 230, 231

[56] References Cited

U.S. PATENT DOCUMENTS

| | | | |
|---|---|---|---|
| 2,492,249 | 12/1949 | Willard et al. | 366/59 |
| 2,618,472 | 11/1952 | Castendyck | 366/59 |
| 3,933,341 | 1/1976 | Hudelmaier | 366/57 |
| 4,154,534 | 5/1979 | Lawrence et al. | 366/59 |
| 4,643,647 | 2/1987 | Perry . | |
| 4,722,608 | 2/1988 | Salzman et al. . | |
| 4,810,167 | 3/1989 | Spoltman et al. . | |
| 5,056,924 | 10/1991 | Christenson . | |
| 5,178,457 | 1/1993 | Helmy . | |
| 5,378,061 | 1/1995 | Christenson . | |
| 5,427,449 | 6/1995 | Christenson et al. . | |

FOREIGN PATENT DOCUMENTS

| | | | |
|---|---|---|---|
| 222 584 | 12/1961 | Anguilla | 366/59 |
| 654 041 | 12/1962 | Canada | 366/59 |
| 766 515 | 6/1934 | France | 366/229 |

*Primary Examiner*—Tony G. Soohoo
*Attorney, Agent, or Firm*—Nikolai, Mersereau & Dietz, P.A.

[57] ABSTRACT

A rotatable drum mixer of the type suitable for mounting in a mobile system for mixing and dispensing concrete is disclosed that includes a single full-length main helical mixing fin upstanding from the interior of the mixer, an auxiliary agitating fin in a forward portion of the drum and a pair of outlet flights near a discharge section of the drum mixer.

18 Claims, 5 Drawing Sheets

CONCRETE MIXING DRUM FIN STRUCTURE

BACKGROUND OF THE INVENTION

I. Field of the Invention

The present invention relates generally to inclined axis rotary drum batch mixers for mixing and dispensing concrete. More particularly, the invention relates to an improved configuration of mixing fins deployed within rotary drum batch mixers of the class and which improves overall performance, particularly improving the ability of the mixer to control concrete discharge. The invention further relates to reducing drum weight and maintenance and is particularly applicable to mobile rotary mixing drums carried by concrete mixing trucks.

II. Related Art

Concrete mixing trucks are widely used in the construction industry for preparing and transporting concrete mixtures to desired locations for use. A mixing truck typically includes a rotatable mixing drum which has fins or agitators mounted inside for mixing and directing the movement of the concrete mixture therein. Conventionally, the fins have a spiral or helical configuration, including a plurality of flights, which tends to blend and mix the concrete when the mixing drum is rotated in a first direction and urge the concrete toward a discharge chute when the mixing drum is turned in the opposite direction.

In the past, concrete mixing drums of conventional design have been provided with helical mixing and discharge fins in the form of two spiral mixing flights located symmetrically opposite each other, i.e., rotated 180° apart in the drum structure. These two flights are normally identical to each other in most conventional designs especially toward the discharge end. An exemplary composite non-metallic fin compositions and construction is shown in U.S. Pat. No. 5,178,457 to Helmy. The design of a typical conventional concrete mixing drum of the class and with particular reference to the fin structure is illustrated and described in U.S. Pat. Nos. 5,056,924, 5,378,061 and 5,427,449, all of which are assigned to the assignee of the present application and are deemed incorporated herein by reference for any purpose. That class of design is further illustrated in FIGS. 1 and 2.

FIG. 1 is a side elevational view of a mobile system for mixing and dispensing concrete with a portion of the mixing drum wall cut away to expose the fins. The mobile system includes a mixing truck 10 having a cab portion 12 and a rear portion 14 which has a main frame 16. A mixing drum 18 is mounted for rotation on a front support frame 20 and rear support frame 22, both of which are integral with the main frame 16. A rearward portion of the mixing drum 18 is positioned adjacent a discharge mechanism 24 which includes a funnel for charging concrete components into the mixing drum 18, as well as a portion for discharging mixed concrete into a main chute 26, as is well known in the art. Main chute 26 is supported relative to rear support frame 22 by a pivot joint 28 which, in turn, enables main chute 26 to be positioned over a set of forms or other desired location for use of the mixed concrete.

As may be seen in FIGS. 1 and 2, mixing drum 18 includes a front head cone 31 and front cone 30, a belly or cross-over portion 32, a big cone portion 34 and a rear tail cone portion 35 which terminates at the end of truck 10 and which is proximate the discharge mechanism 24, which is supported by rear support frame 22. A conventional dual helical or spiral mixing fin assembly 36 is mounted to an inner surface of an outer wall and extends transversely into the mixing space of mixing drum 18.

The fin assembly 36 includes a first rearwardly curving segment 37, a second forwardly curved fin segment 39 and a transitional fin portion 41 which connects the rearwardly curving segment 37 and the forwardly curving segment 39. As can be seen from the figures, a concrete mixture will be agitated by the fin segments 37, 39 and 41 when mixing drum 18 is caused to rotate in a first direction, while the fin segments will urge the mixture toward the discharge mechanism 24 when the rotational direction of the mixing drum 18 is reversed. The forward curving fin segment 39 acts to help lift and toss the mixture toward the middle of the drum 18 when the drum 18 is rotated to mix the material. The various sections of spiral fin assembly 36 are secured in the mixing drum 18 in a conventional manner.

As can be seen, particularly in FIG. 1, concrete mixing drums of conventional design have had a mixing fin assembly 36 which forms spiral mixing flights located symetrically opposite and rotated 180° apart. The two flights are usually identical to each other in most conventional designs, especially in the discharge portion. As stated, the rotation of the drum in a given direction allows material to be loaded into the drum and agitated, while rotation of the drum in the opposite direction will discharge the concrete as it slides off the flighting toward the outlet end. The pitch of the flights varies from one end to the other as needed for optimum performance and the type of action needed in any given area. Particularly in the small end of the drum where the material is loaded into and discharged out of the drum, the spiral spacing and pitch is quite critical. If the pitch be too coarse, the slope of the flight where the concrete is sliding down the flight toward the discharge does not have enough slope angle to slide easily on the flight surface. On the other hand, if the pitch be too fine, the slope is more steeply inclined, but the flights are in much closer spacing with the adjacent, opposite fin. When concrete mixtures with high viscosity and very thick consistencies are used, the concrete will become wedged in between the flights and be difficult to discharge.

It is well known in the art that concrete mixes which have very thick consistencies normally provide higher strength cured concrete and so thick consistency material is generally preferred. It has been a long standing problem in the art of concrete mixing drum technology to arrive at the best spiral pitch when using concrete mixes which have very thick consistencies because, as can be seen from the above, changing the pitch angle either way can cause difficulties with respect to the ability of the mixing drum to discharge the contents. Thus, there remains a need to provide better concrete discharge characteristics particularly with regard to mixes having a thick is consistency in rotary mixing drums. A further goal of the design of portable rotary mixing drums or vessels is to reduce the weight of empty vessels so that additional concrete may be carried without exceeding vehicle load limits.

Thus, a primary object of the present invention to improve the overall performance characteristics of concrete mixing fins in inclined axis rotary drum mixers.

Another object of the present invention is to reduce the overall weight of inclined axis rotary drum mixers carried by cement mixing vehicles.

A further object of the present invention is to improve the ability of inclined axis rotary drum mixers to control the discharge of concrete mixtures over a range of thicknesses or slope values.

A still further object of the present invention is to improve the ability of inclined axis rotary drum mixers to discharge very thick concrete mixtures and particularly the material at the end of a batch.

A yet still further object of the present invention is to reduce material costs and installation expenses in the manufacture and maintenance of inclined axis rotary drum mixers.

Still another object of the present invention is to improve the ability of inclined axis rotary drum mixers to control the discharge of thin concrete mixtures.

Yet another object of the present invention is to reduce the maintenance associated with mixing fins in inclined axis rotary drum mixers, particularly those carried by cement mixing vehicles.

These and various other advantages and features of novelty which characterize the invention are pointed out with particularity in the claims annexed hereto and forming a part hereof. However, for a better understanding of the invention, its advantages and the objects obtained by its use, reference should be made to the drawings and to the accompanying descriptive matter which illustrates a detailed embodiment of the invention.

SUMMARY OF THE INVENTION

The fin assembly according to the invention is adapted for mounting inside a mixing space which is defined by the outer wall of an inclined axis, rotatable mixing drum for mixing and dispensing a mixture such as concrete. An assembly of the invention is particularly suitable for use in a mixing drum designed for a mobile system for mixing and dispensing concrete. The assembly includes a spiral fin assembly extending transversly into the mixing space for mixing and guiding the concrete within the mixing space as the mixing drum is rotated. The spiral fin assembly is designed in a single helical configuration which operates in combination with a complimentary auxiliary agitating fin and discharge control fins.

The spiral pitch of the helical fin of the present invention with regard to the centerline of the drum is less than that of conventional double helix designs and this increases the slope angle for the concrete to slide along during discharge. At the same time, because but a single helix is used, it is not necessary to fit an opposite flight in between the flights of the single helix so that the spacing between the remaining flights is greater than that for earlier double flight designs. This prevents interflight packing of mixed material of thick consistency. In accordance with the invention, the spiral pitch ranges from about 18–20° at the forward section of the drum to about 7–9° aft, which in the aft position is significantly less than that of the conventional double helix design, which typically varies from about 18–20° forward to about 12–14° aft. The pitch is measured from the normal to the drum axis, relative to the circumferential distance of the drum.

The combined effect accomplishes more than giving the drum a greater ability to discharge a high vescosity concrete more rapidly and completely. If a very fluid mix be used, as is the case sometimes with concrete which must be pumped to upper construction floors, the amount of concrete discharged by the single spiral will be somewhat reduced. Because conventionally designed drums often discharge this type of concrete much faster than desired, this may also provide a control advantage for the discharge of such material.

As seen in the exemplary detailed embodiment, additional short outlet flights which are not part of the regular single helix or spiral are provided to help regulate the outgoing flow of concrete. These prevent a sudden surge of concrete as the full-length single spiral flight pushes out the material behind it. The present invention uses a plurality (preferably two) of separate short oulet flights that are preferably located approximately 120° to either side of the main single spiral. These separate short outlet flights can be designed to have any convenient pitch and normally have a finer pitch and greater spacing between main spiral and short flights than is conventionally used consistent with the advantages of the present system. These assist in producing an important aspect of the advantage produced by the present invention which results in a drum having concrete discharge characteristics for concrete of varying viscosities which occur at a more consistent rate with significantly reduced tendencies toward clogging and uneven surging.

In conjunction with the single spiral, the fin configuration of the invention provides a second partial mixing blade which is attached as a lone fin toward the front of the drum spaced therefrom and located at about a 180° rotation from the adjacent single full-length spiral flight. This second partial mixing flight is necessary only in the mixing end of the drum where aggressive mixing action is needed and does not extend into the middle and outlet end where an aggressive mixing action is not necessary. The second partial mixing blade also helps to offset the rotation torque requirement of the first single full-length spiral so that the torque can remain fairly constant. A long bar supporting the auxiliary mixing bin is located near one end thereof where it also serves to break up unmixed clumps of ingredients within the material being mixed. By not using a conventional second full-length spiral, the drum can be rotated more easily. The second partial mixing flight will provide agitation where it is most needed and energy is not wasted on agitating the concrete where it does not need to be aggressively agitated. The single full-length spiral flight can provide enough moderate agitation for the outlet end of the drum. The second partial mixing flight has an additional support bar which helps to hold the free end in place. It is fairly long and located where a large volume of concrete rapidly passes through as the concrete is mixed. This causes a slicing action that helps to break up clumps of unmixed concrete.

The present invention has other aspects which impart advantages over more conventional designs. By eliminating one main spiral, a large amount of weight is removed which allows for additional payload to be hauled without causing the concrete mixer truck to become overweight. Additional benefits are realized with associated reduced material costs and installation expenses. Because the flights are farther spaced and they have higher slope angles, there is less of a tendency for concrete to build up on the surface of the flights. In addition, there is less surface area to carry concrete buildup which reduces cleaning maintenance. Another advantage is that the drum requires less horsepower (torque) for rotation due to reduced surface area on the remaining single spiral and finer pitch. This translates to reduced energy consumption and less wear and maintenance on the driving machinery.

Of course, the fin assembly may be constructed of any suitable fin material from metals and metal alloys to lighter weight, resilient polymeric materials which are more flexible and abrasion resistant, including polyurethanes, polyurethane blends and polyolefin materials, including high density polyethylene and polyethylene blend combinations, including coated metallic fins and composite elastomer fins are also contemplated.

These design features of the single full-length spiral flight along with the second partial mixing flight and a plurality of short outlet flights give an improvement in function and at the same time reduce the weight, particularly in the case of metal fins, and cost of manufacture over more conventional designs with two full-length spiral flights. Typical weight savings is about 300 pounds≅(140 kg).

BRIEF DESCRIPTION OF THE DRAWINGS

In the drawings wherein like numerals designate like parts throughout the same.

DETAILED DESCRIPTION

Figure 1:
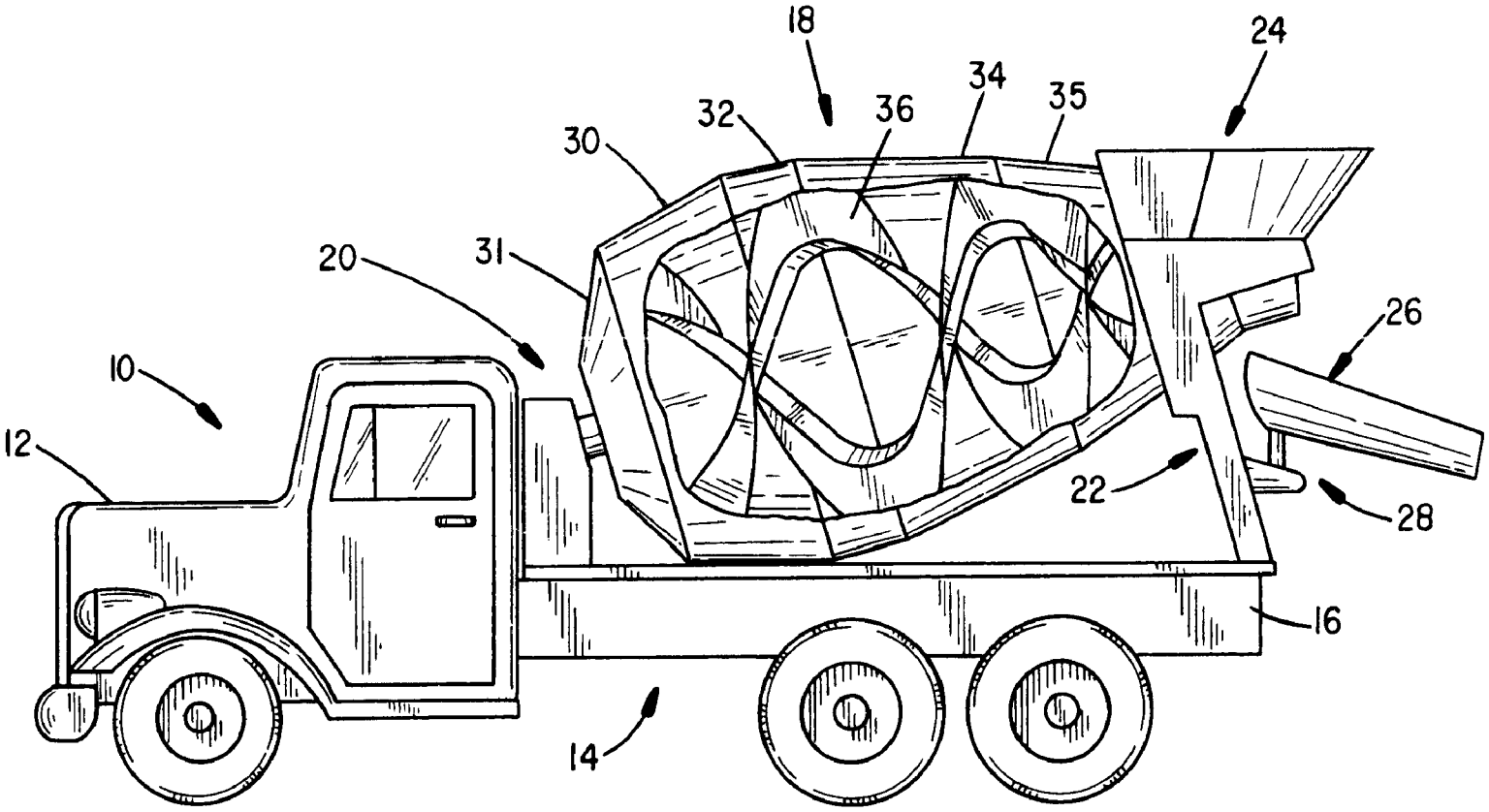
FIG. 1 (PRIOR ART)
FIG. 1 is a side elevational view, with parts cut away to show the fin pattern, of a mobile system for mixing and dispensing concrete according to a conventional design.
Figure 2:
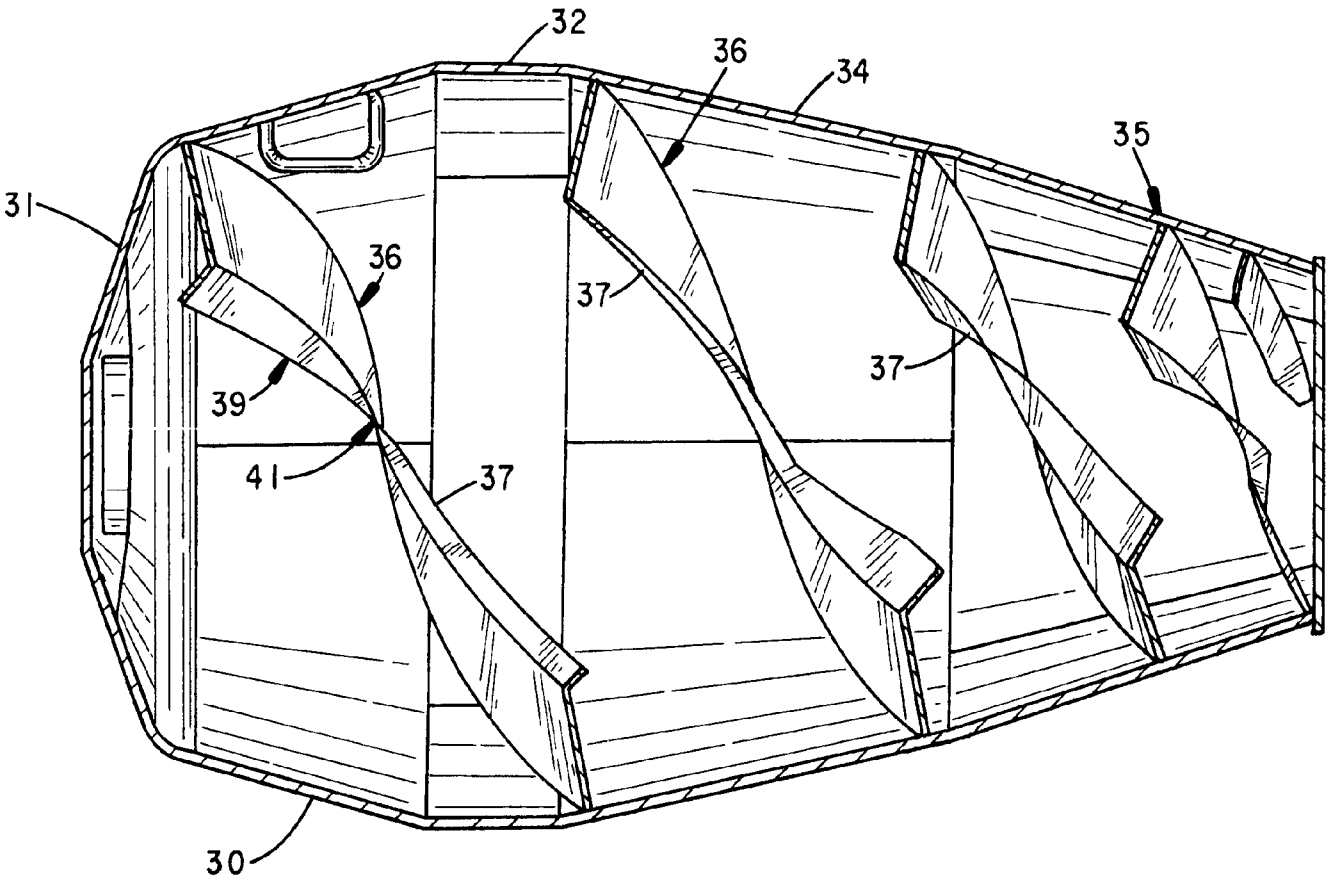
FIG. 2 (PRIOR ART)
FIG. 2 is a fragmentary elevational view of a mixing drum of the mixing system illustrated in FIG. 1 showing the drum cut in half through the central axis with the half shell and corresponding internal flight portions removed.
Figure 3:
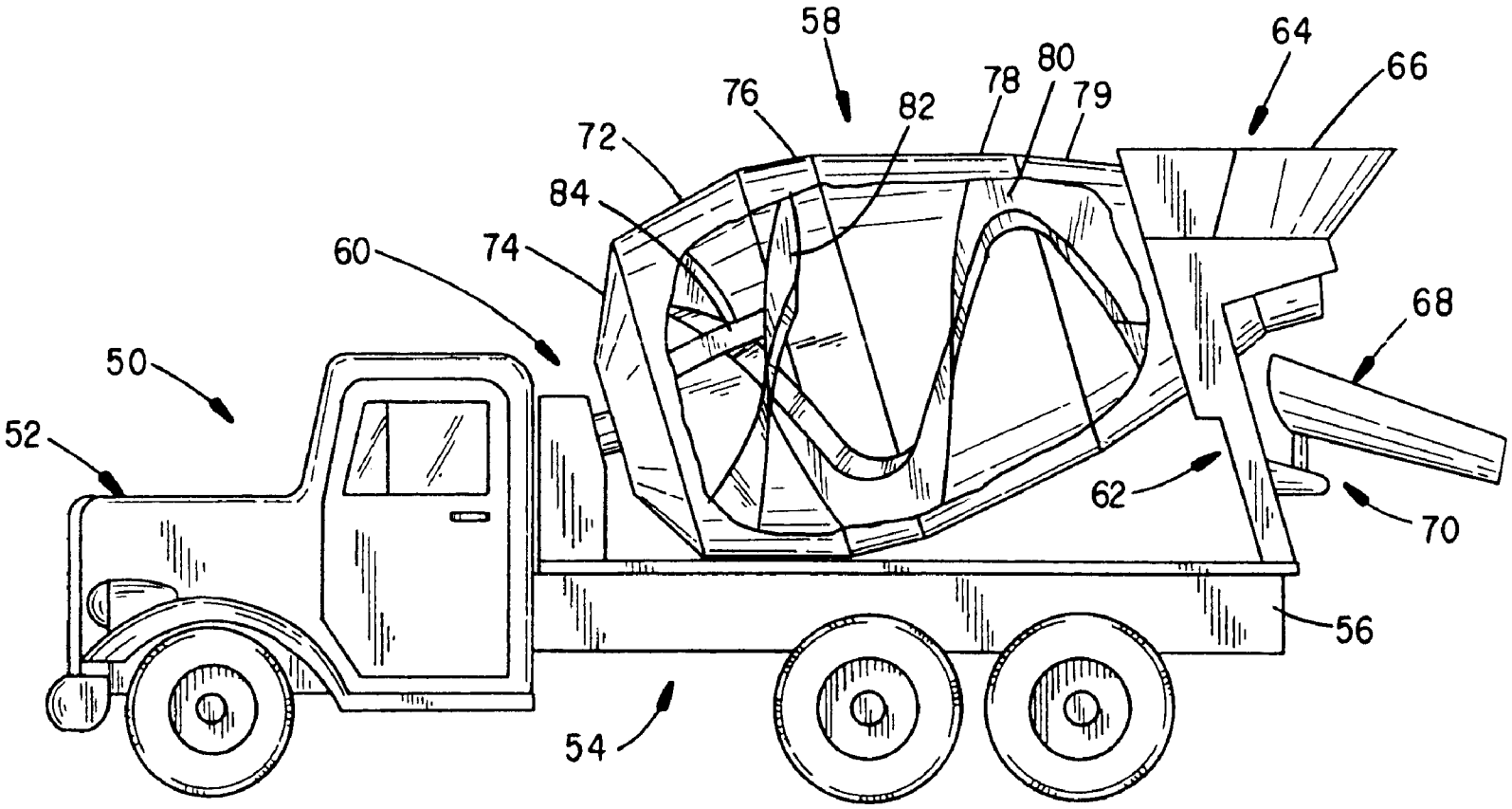
FIG. 3 is a side elevational view of a mobile system for mixing and dispensing concrete with parts cut away exposing part of a fin system according to a detailed embodiment of the invention.
Figure 4:
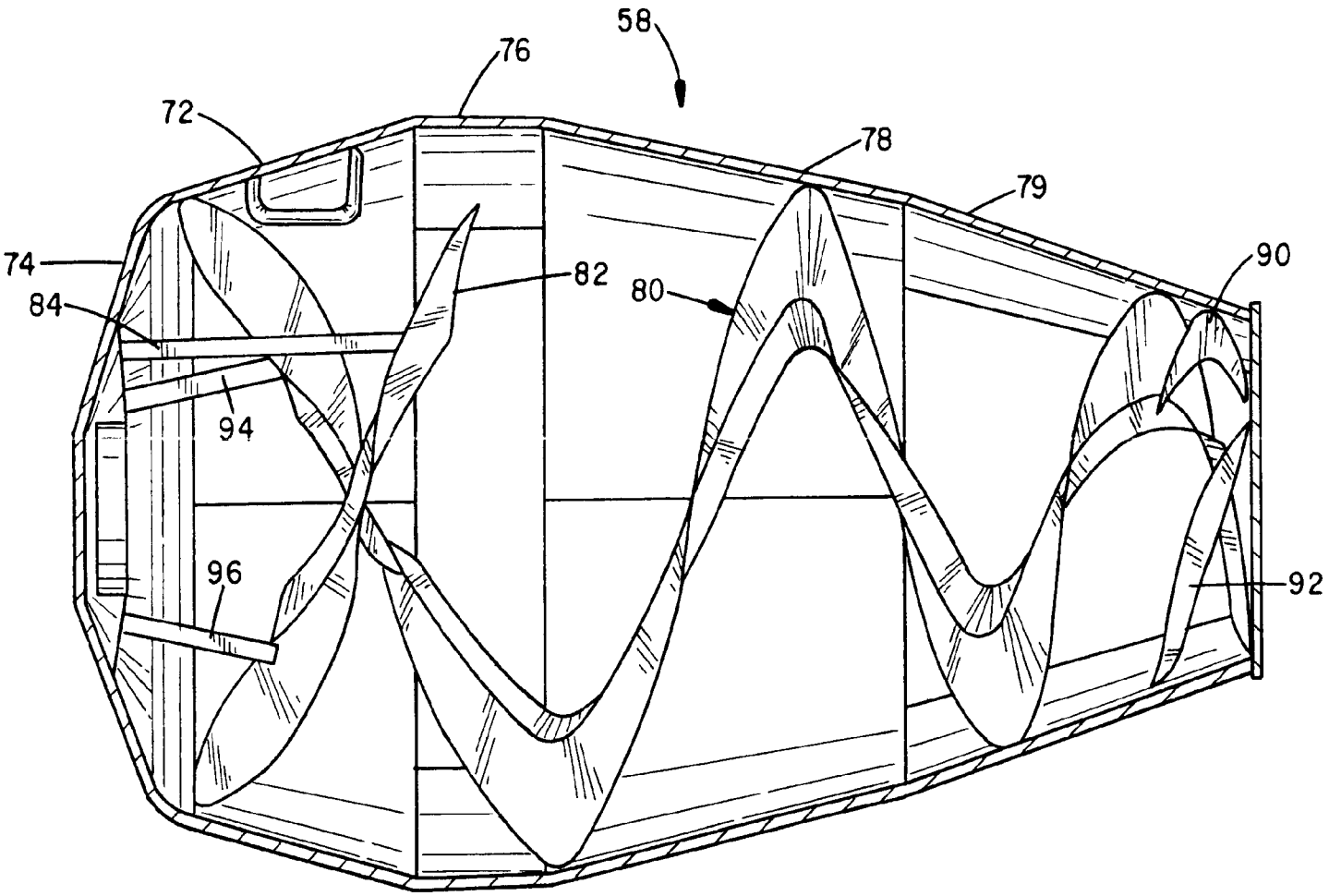
FIG. 4 is a fragmentary elevational view of a mixing drum of the mixing system illustrated in FIG. 3 with half of the shell removed exposing the fin structure.
Figure 5:
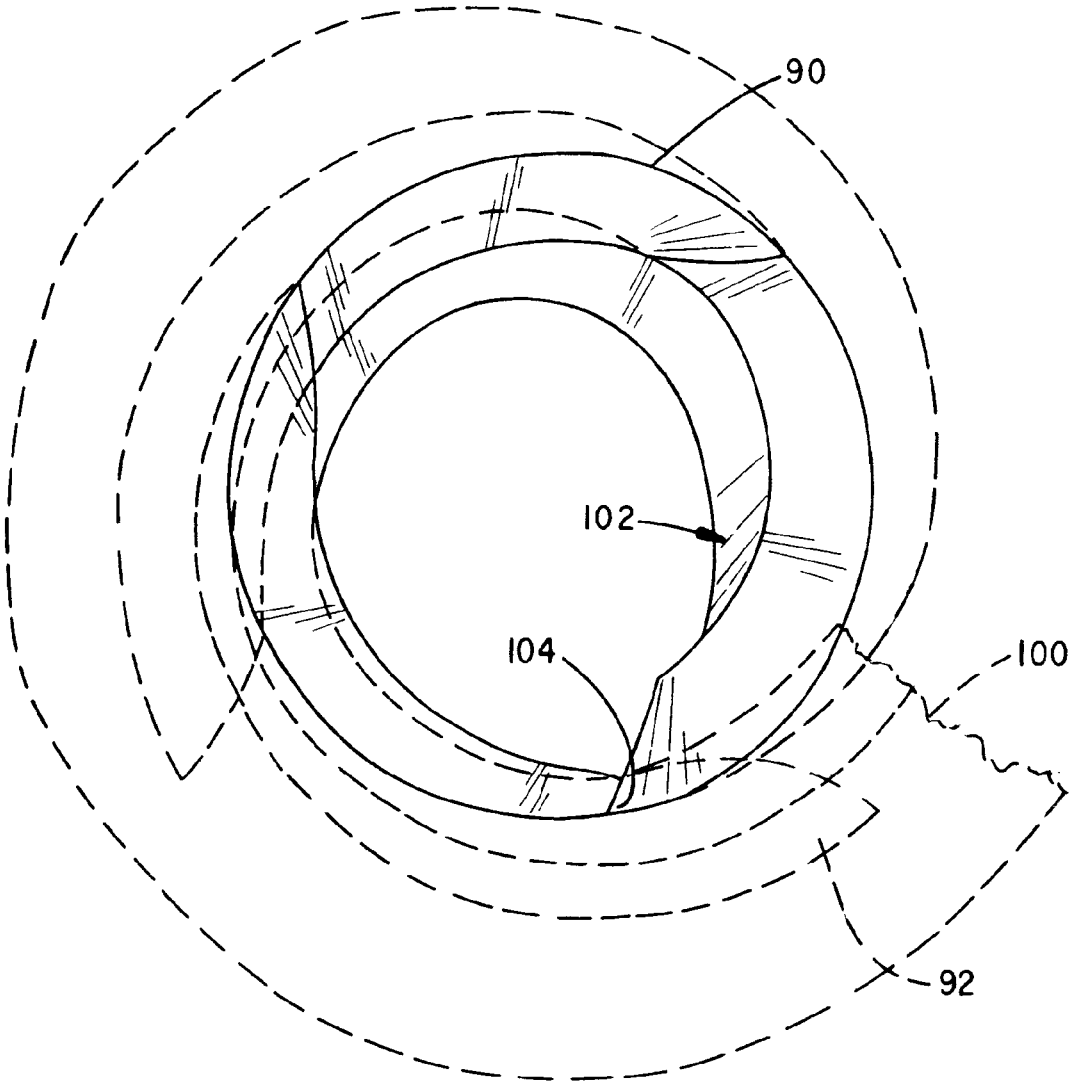
FIG. 5 is an end view of the mixing drum of FIG. 4 showing only the rearmost portion of the drum and internal flight parts.

Having described the pertinent parts of a conventional mobile mixing system for mixing and dispensing concrete, including the vehicle configuration of the mixing fins illustrated in FIGS. 1 and 2 in describing the related art, reference may now be made to FIGS. 3–5 of the drawings for a description of an illustrative detailed embodiment of the present invention. The particular detailed configuration is, of course, presented by way of illustration and is not intended to limit the scope of the inventive concept in any way.

With this in mind, in FIG. 3, there is shown a mixing truck at 50 constructed according to a detailed embodiment of the invention, including a cab portion 52 and a rear chassis portion 54 which includes a main frame 56. A mixing drum 58 is mounted for rotation on a front support frame 60 and a rear support frame 62, both of which are integral with the main frame 56. A rearward portion of the mixing drum 58 is positioned adjacent a discharge mechanism 64 which includes a funnel for charging or loading concrete components into mixing drum 58, as shown at 66, as well as a portion for guiding mixed concrete into a main discharge chute 68, which is supported relative to rear support frame 62 by a pivot joint 70 which enables the main chute 68 to be conveniently positioned over a desired location for discharging concrete. It will be appreciated that other details of the truck 10, commonly associated with such devices, are well known and readily available to those skilled in the art and further descriptions of these parts here is considered unnecessary.

As in the mixing drum of FIG. 1, the mixing drum of FIGS. 3 and 4 includes a head cone section 74, with front cone section 72, a belly or cross-over portion 76, a big cone section 78 and a rear tail cone portion 79 which terminates toward the end of the truck 10 which is proximate to the discharge mechanism 64 which is supported by the frame 62.

An improved helical or spiral mixing fin system made in accordance with the invention is shown in the cut away section generally at 80 depicting the full-length spiral of the single helix mixing fin. Note that the front portion is provided with an additional short agitating fin pictured at 82 stabilized by an additional support bar or other structural member 84 connected to the front of the mixer drum 58 to stabilize the fin 82 relative to the single helix. The bar 84 also serves to break up clumps of unmixed material sliding off of the main mixing bin. As can be seen in FIG. 4, in addition to the main spiral or helical mixing fin 80 and the forward agitating fin 82, a pair of short outlet flights are also provided at 90 and 92, respectively. Additional support bars for the agitators are shown at 94 and 96. The finer pitch of the spiral is clearly evident from a comparison of the FIGS. 3 and 4, with FIGS. 1 and 2.

Certain additional details are shown in the end view of FIG. 5 which better projects the provision of full circumference of fin coverage of the tail section, including aspects of the full-length single spiral flight 80 in relation to the two short outlet flights 90 and 92 in which the full-length single spiral flight is shown with one end broken at 100 and the end of the flange of the full-length single spiral depicted at 102. The full-length single spiral or flight terminates at 104. The first outlet flight 90 is shown in phantom outline as is the second outlet flight 92. These overlap somewhat in covering the remainder of the circumference of the posterior mixing drum.

With the simplified combination fin system of the present invention, as exemplified in FIGS. 3–5, the thorough mixing characteristics of more complicated prior patterns are achieved and the material discharge characteristics are greatly improved. For drums of average size (about 10 cubic yard capacity), the double full-length fins of prior systems subtended an angle or were of a finer average pitch which allowed them about 1½ to 2 revolutions of the drum in traveling from end to end of the drum. The full-length fin of the present invention are of an average pitch which allows between 2½ and 2¾ revolutions of a similar sized drum in traveling the length thereof. The majority of the increased turns of the spiral occur toward the outlet end of the drum.

It will be appreciated that an important aspect of the invention is the combination of the single helix spiral or flight with the fine pitch at the rear or discharge end of the drum in combination with the short agitating and discharge controlling fins. The pitch of the main fin at the aft portion of the mixture is generally from about 7° to about 9° from the normal. Location of the discharge fins spaced about 120° apart center to center and angled with a similar fine pitch provides with the end of the main fin, the desired controlled discharge formerly unavailable.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A rear discharge rotatable drum mixer of the type suitable for mounting in a mobile system for mixing and dispensing concrete comprising:

(a) a single full-length main helical mixing fin upstanding from the interior of the mixer;

(b) an auxiliary agitating fin in a forward portion of the drum; and (c) a pair of discharge fins near a discharge section of the drum mixer wherein the discharge fins are located about 120° apart center to center.

2. The apparatus of claim 1 wherein the pair of discharge fins overlap each other and the main helical mixing fin.

3. The apparatus of claim 1 wherein the pitch of the main fin and the pair of discharge fins near the discharge section of the mixer is from about 7° to about 9° from the normal.

4. A rear discharge rotatable drum mixer of the type suitable for mounting in a mobile system for mixing and dispensing concrete comprising:

(a) a single full-length main helical mixing fin upstanding from the interior of the mixer;

(b) an auxiliary agitating fin in a forward portion of the drum symmetrically located with respect to the main mixing fin; and (c) a pair of discharge fins near a discharge section of the drum mixer wherein the discharge fins are located about 120° apart center to center.

5. The apparatus of claim 4 wherein the pair of discharge fins overlap each other and the main helical mixing fin.

6. The apparatus of claim 4 wherein the pitch of the main fin and the pair of discharge fins near the discharge section of the mixer is from about 7° to about 9° from the normal.

7. A rear discharge rotatable drum mixer of the type suitable for mounting in a mobile system for mixing and dispensing concrete comprising:

(a) a mixing drum including a single full-length main helical mixing fin upstanding from the interior of the drum and having forward and aft portions characterized by foreword and aft pitches;

(b) a short auxiliary agitating fin in a forward portion of the drum positioned opposite the forward portion of said main helical mixing fin and having a pitch similar to the forward pitch; and (c) at least one short discharge fin near the aft discharge section of the drum mixer and having a pitch similar to the aft pitch of the main helical mixing fin.

8. The apparatus of claim 7 wherein the aft pitch is from about 7° to about 9° from the normal.

9. The apparatus of claim 7 wherein the agitating fin is symmetrically located with respect to the main helical mixing fin.

10. The apparatus of claim 9 further comprising a pair of discharge fins symmetrically located with respect to the aft portion of said main helical mixing fin.

11. The apparatus of claim 10 wherein the pair of discharge fins overlap each other and the main helical mixing fin.

12. The apparatus of claim 11 wherein the discharge fins are located about 120° apart center to center.

13. The apparatus of claim 9 wherein the auxiliary agitating fin is supported near one end by a long member which acts to break up unmixed clumps within the material being mixed.

14. The apparatus of claim 7 further comprising a pair of discharge fins symmetrically located with respect to the aft portion of said main helical mixing fin.

15. The apparatus of claim 14 wherein the pair of discharge fins overlap each other and the main helical mixing fin.

16. The apparatus of claim 14 wherein the discharge fins are located about 120° apart center to center.

17. The apparatus of claim 7 wherein the fins are of a non-metallic composition.

18. The apparatus of claim 7 wherein the auxiliary agitating fin is supported near one end by a long member which acts to break up unmixed clumps within the material being mixed.

* * * * *